US006993817B1

(12) United States Patent
Swinger

(10) Patent No.: US 6,993,817 B1
(45) Date of Patent: Feb. 7, 2006

(54) METHOD OF ASSEMBLING FENCE SECTIONS

(75) Inventor: John L. Swinger, Columbus, OH (US)

(73) Assignee: Crane Plastics Company LLC, Columbus, OH (US)

( * ) Notice: Subject to any disclaimer, the term of this patent is extended or adjusted under 35 U.S.C. 154(b) by 0 days.

(21) Appl. No.: 10/062,167

(22) Filed: Jan. 31, 2002

(51) Int. Cl.
*E04H 17/00* (2006.01)

(52) U.S. Cl. ..... 29/429; 53/399; 256/61; 256/29; 256/62

(58) Field of Classification Search ..... 29/525.05, 29/782, 525.01, 798, 429, 243.57; 53/399, 53/582, 588; 206/83.5, 321; 256/57, 19, 256/71, 61, 62, 60, 28, 29, 24
See application file for complete search history.

(56) References Cited

U.S. PATENT DOCUMENTS

| | | | | | |
|---|---|---|---|---|---|
| 60,357 | A | * | 12/1866 | Gerard | |
| 286,057 | A | * | 10/1883 | Overhuls | 256/61 |
| 317,623 | A | * | 5/1885 | Calhoun | 256/62 |
| 362,074 | A | * | 5/1887 | Gibson | |
| 558,164 | A | * | 4/1896 | Ervin | 256/61 |
| 821,232 | A | * | 5/1906 | Frizzel | 256/28 |
| 2,237,669 | A | * | 4/1941 | Higman | 256/34 |
| 3,954,226 | A | * | 5/1976 | Pickering | |
| 4,072,094 | A | * | 2/1978 | Smitherman et al. | |
| 5,375,815 | A | * | 12/1994 | Akins | 256/26 |
| 5,581,868 | A | * | 12/1996 | Bisch | 29/525.08 |
| 5,645,270 | A | * | 7/1997 | Lawrence | 256/66 |
| 5,806,779 | A | * | 9/1998 | Crum | |
| 5,873,564 | A | * | 2/1999 | Bisch | 256/65 |
| 6,058,601 | A | * | 5/2000 | DeKoning | 29/798 |
| 6,363,689 | B1 | * | 4/2002 | Rodriguez et al. | 53/399 |
| 6,385,901 | B1 | * | 5/2002 | Wahlberg | 256/32 |
| 2001/0048101 | A1 | * | 12/2001 | Bligh et al. | 256/13.1 |

* cited by examiner

*Primary Examiner*—David P. Bryant
*Assistant Examiner*—Jermie E. Cozart
(74) *Attorney, Agent, or Firm*—Standley Law Group LLP

(57) ABSTRACT

The present invention is a method of assembling fence sections using a banding machine to band an assembled fence section together so that the fence section does not fall apart as it is transferred to the site where it will be used. The fence section may be assembled at the beginning of an assembly line. The fence section may then move along the line toward the banding machine. The fence section is then banded and moved through the banding machine to be placed into a box.

12 Claims, 6 Drawing Sheets

METHOD OF ASSEMBLING FENCE SECTIONS

BACKGROUND AND SUMMARY OF THE INVENTION

The present invention relates generally to fences, and more particularly, to a method of assembling fence sections together for easy installation. Fences have been used in various forms for thousands of years to protect and secure people, animals and land. Fences have also been used to exclude intruders. Specifically, farmers have used fences to contain live stock and domestic animals in a controlled area or to prevent predators from entering. While these functional fence uses continue today, fences are also used for decorative purposes such as on porches and around yards, decks and gardens.

The type of use a fence is intended to have will have an effect on the type of material used for the fence. Fencing material comes in a wide array of materials, traditionally including wood and wrought iron. However, wood fences tend to require extensive effort to build, need a lot of maintenance and can be difficult to remove or alter. Wrought iron fences also presents problems, such as rusting. Recently, plastic has been used in place of wood and metal because it is easier to install, needs little maintenance and is aesthetically appealing without the problems associated with wood and metal.

Fence construction and assembly is generally well known. The individual components of a fence are fastened to vertical posts using various types of connectors. Common connectors include nails, screws, bolts, wire and clips. Various connectors exist and are continually developed in order to provide ease to fence installation and maintenance.

One way of making fence installation easier is to pre-assemble fence sections (comprised of pickets assembled to rails) so that the consumer is able to purchase entire fence sections without having to install each picket and rail individually at the site. Fence sections have become quite popular because of their ease and reduced time in installation. All that is needed are fence sections and posts for each section to be secured to.

However, one of the problems associated with fence sections, especially fence sections made from vinyl and other plastics where the purchaser does not want visible hardware on the fence, is that the fence sections tend to come apart as the installer is removing them from the packaging box in which they may be shipped, or as he is transporting the fence section from the box to the site where the fence section is to be placed. This problem defeats the purpose and ease of fence sections since the installer must then take extra time to put the fence section back together before it is able to be installed.

Efforts have been made to solve this problem by gluing the fence pickets into channels of the rails. Screws, rivets or other fasteners have also been used to hold the individual fence pickets and rails together in the sections. However, these potential solutions have created additional problems. For example, the glue has a tendency to leak or to dry improperly so that the glue can be seen or the pickets are aligned improperly because the pickets shifted before the glue dried. This has caused gaps between the pickets and uneven pickets, without the ability to rearrange the already glued pickets of the fence sections. Screws, rivets and other fasteners have also been used to secure the pickets in place in the channels of the rails. This was not a satisfactory solution either since the screws, rivets and other fasteners were not aesthetically appealing and made the fence look less appealing due to the exposed hardware. Even fasteners constructed from plastic made the fence look unappealing. Removing the screws, rivets or other fasteners once the section was installed at the site seemed to be an option, but that took a lot of time and the holes were visible which again made the fence look unappealing.

Another problem with using glue, screws, rivets or other fasteners to hold the fence pickets in the channels of the rails of each fence section is that the vinyl fencing material tended to buckle or gap during various seasons. Vinyl and other plastic fencing material tends to contract in cold weather and expand in warm weather. When each individual picket is fastened in place, it is unable to move or shift as necessary to adjust for the expansion and contraction of the material when the weather changes. Without using any type of fasteners, the fence pickets could shift accordingly along the channels of the rails and adapt to the adjacent picket as dictated by the material expanding and contracting. However, if rail fasteners are not used, then this leads back to the problem of the fence sections not staying together as the installer removed the fence section from the box or as it was being moved from the box to the site where it was to be installed.

The present invention relates to a method of assembling fence sections so that installation of each section is improved and the problems associated with using glue, screws, rivets or other fasteners are avoided. The present invention is a method of assembling fence sections using at least one plastic band to secure the fence section components together so that the fence section does not fall apart as it is removed from the box or as it is transferred from the box to the site where it is to be installed. One or more plastic bands are placed around the assembled fence sections using an automatic banding machine preferably located at or on the assembly line. Banding machines are known, and may be purchased from companies such as Strapak Inc. in Hayword, Calif.

The fence assembling process may begin by the fence section components being assembled into a complete section on a flat surface at the beginning of the assembly line. The assembled fence section is then moved along the assembly line to a first area of rollers. The rollers aid in moving the fence section along the assembly line until it reaches the banding machine. The banding machine is of a size large enough to allow the fence section to move through it. Once the fence is in the banding machine, any number of plastic bands may be placed around the fence section. Usually, one to two bands are preferred to secure the fence section together. Once banded, the fence section moves along a second area of rollers towards the end of the assembly line and into a shipping box. Once the fence sections are installed at the site, the bands can be readily cut and removed.

In addition to the novel features and advantages mentioned above, other objects and advantages of the present invention will be readily apparent from the following descriptions of the drawings and exemplary embodiments.

BRIEF DESCRIPTION OF THE DRAWINGS

Referring now to the drawings.

DETAILED DESCRIPTION OF THE PREFERRED EMBODIMENT(S)

The present invention is a method of assembling fence sections using at least one plastic band to secure the fence section components together. This allows the fence section to be removed from the shipping box and transported to the site where it is to be installed without falling apart. One or more plastic bands are placed around the assembled fence sections using an automatic banding machine located on the assembly line.

Figure 1:
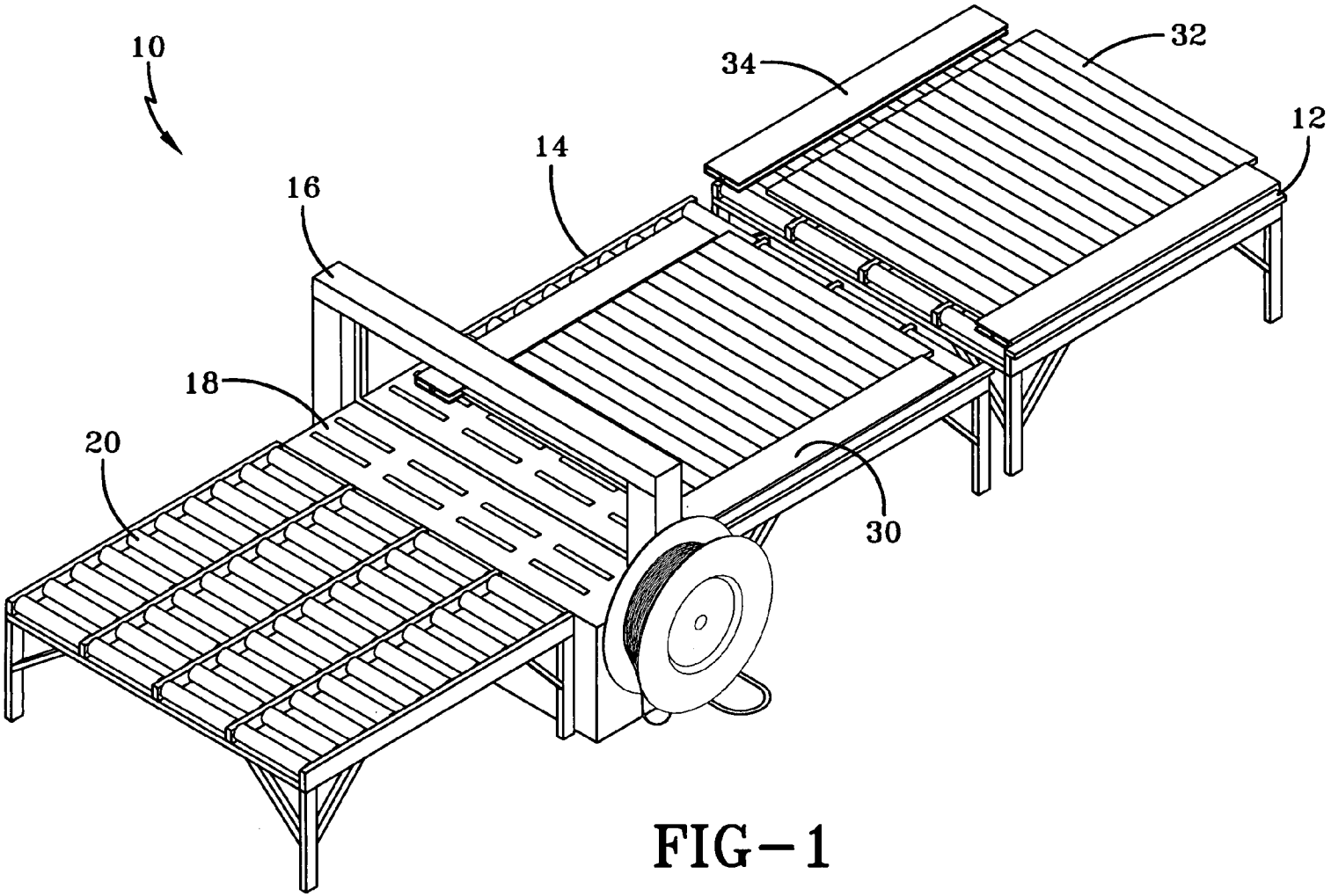
FIG. 1 is a perspective view of an exemplary embodiment of the assembly line and banding machine used in the method of assembling fence sections.
Figure 2:
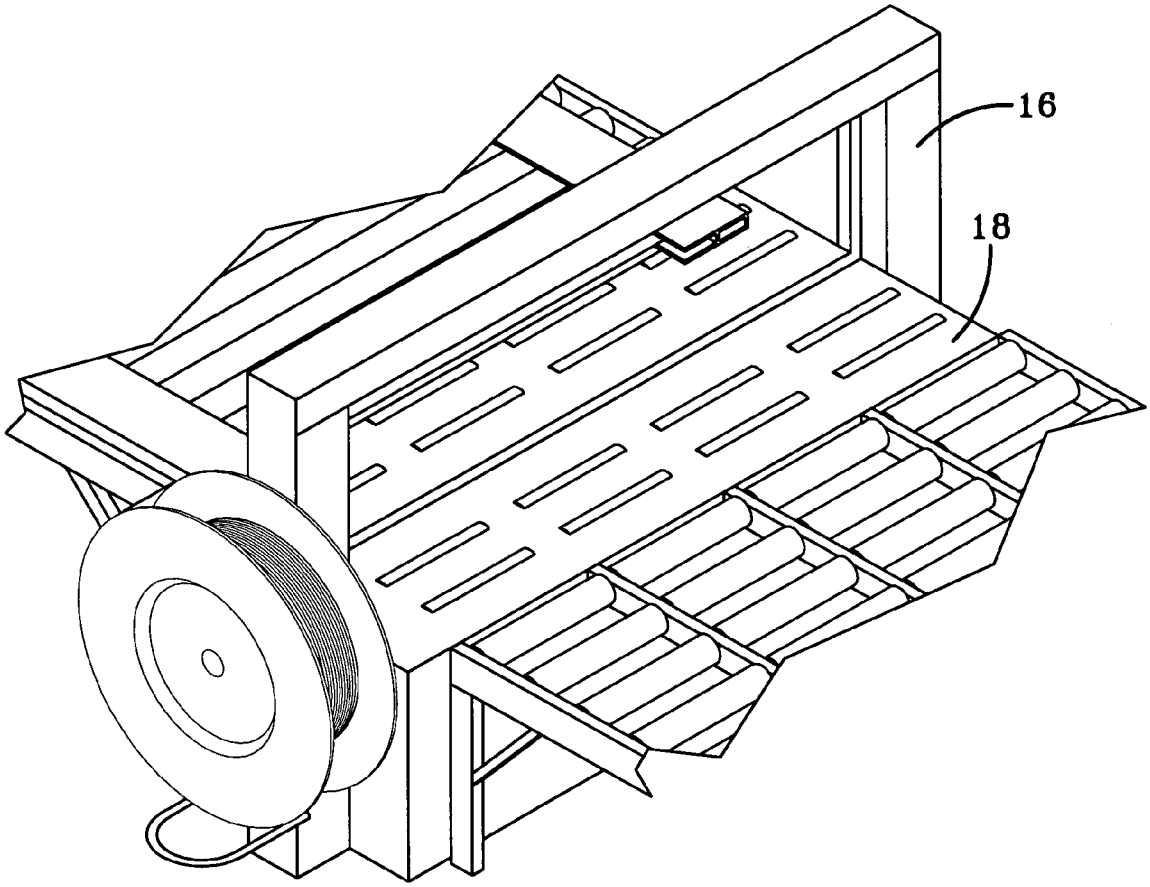
FIG. 2 is a perspective view of the banding machine and banding area of FIG. 1.

FIG. 1 shows an exemplary embodiment of the assembly line 10 with banding machine 16 used in the method of assembling the fence sections 30. The assembly line 10 preferably includes a flat working area 12, a first area of rollers 14, a banding machine 16 adapted to band a fence section, and a second area of rollers 20 at the end of the assembly line 10 where the fence sections 30 may then be placed into shipping boxes. FIG. 2 shows a close view of the banding machine 16 and banding area 18.

Figure 3:
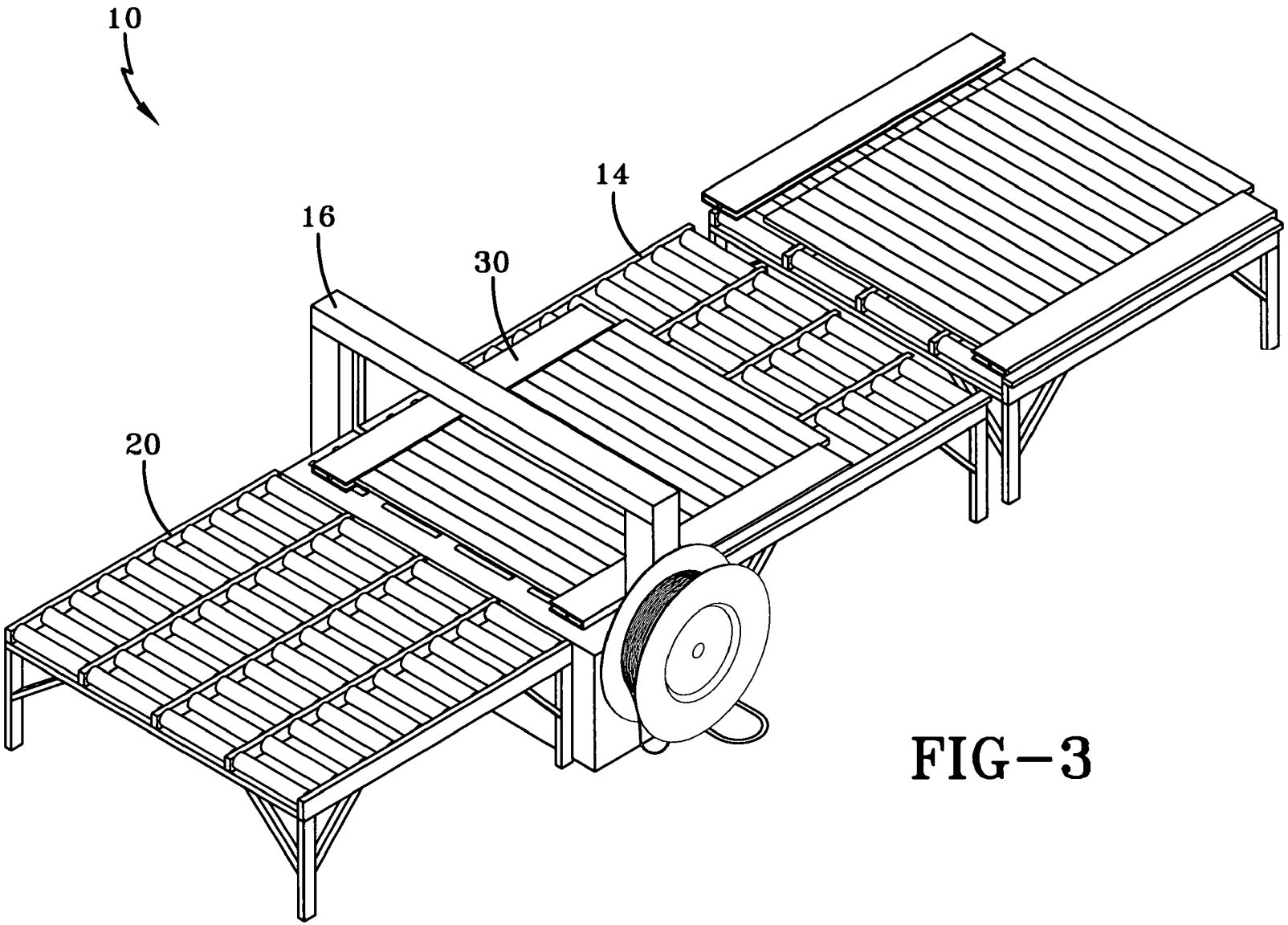
FIG. 3 is perspective view of the assembled fence section being moved along the first area of rollers on the assembly line into the banding machine.

The fence assembling process begins by assembling the fence section 30 on a surface 12 at the beginning of the assembly line 10, as shown in FIG. 3. A wide variety of pickets 32 and rails 34 may be used to construct the fence sections 30. However, fence rails 34 typically have a U-shaped channel into which an end of the pickets 32 are received. This channel helps to stabilize the pickets from lateral movement and provides a stop which stabilizes the pickets from vertical movement.

Figure 4:
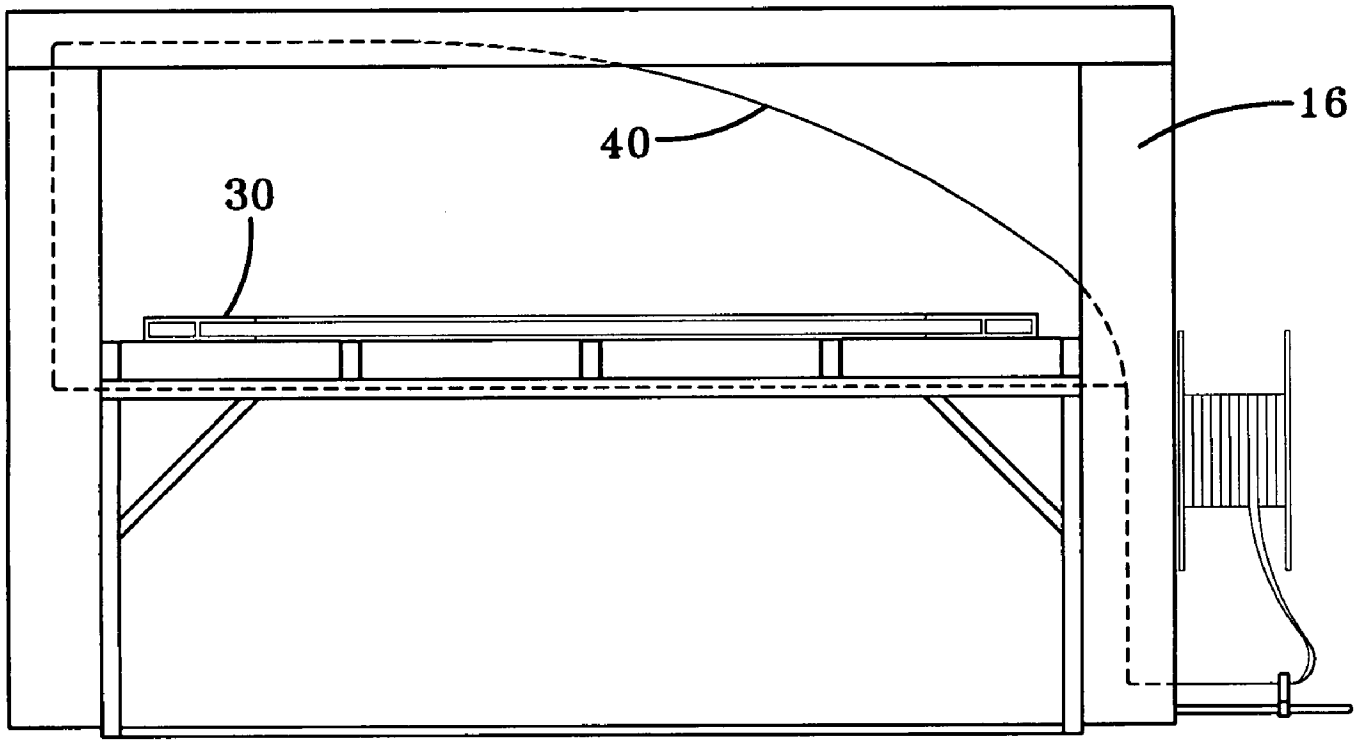
FIG. 4 is an end view of the banding machine as it is banding a fence section.

The assembled fence section 30 may then be moved along the assembly line 10 to a first area of rollers 14. The rollers 14 aid in moving the fence section 30 quickly and easily along the assembly line 10 until it reaches the banding area 18 and banding machine 16, as shown in FIG. 3. The plastic bands 40 are banded around the assembled fence sections 30 using an automatic banding machine 16 located on the assembly line 10. FIG. 4 shows an exemplary embodiment of the banding machine 16 as it is banding an assembled fence section 30.

A banding machine 16 is used in this unique method of assembling fence sections. The banding machine 16 of the present invention may be adapted to enable the assembled fence section 30 to move easily through as it is banded.

Figure 5:
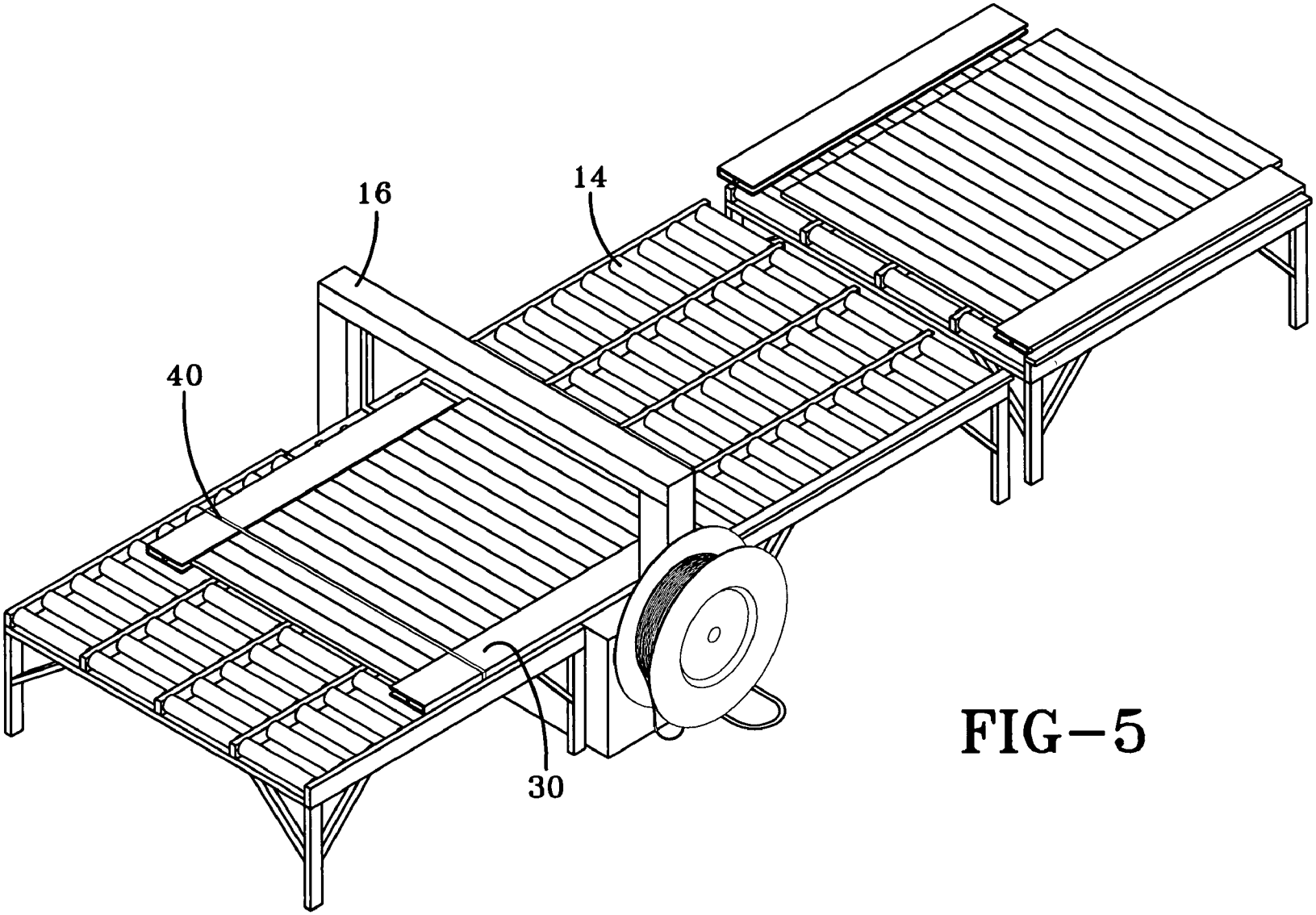
FIG. 5 is a perspective view of the assembled fence section having one band and being moved through the banding machine onto a second area of rollers.

Once the fence section 30 is in the banding machine 16, any number of bands 40 (preferably plastic bands, although other materials may be used, such as metal bands) may be placed around the fence section 30. Usually, one to two bands 40 are preferred to secure the fence section 30 together. If a second band 40 is required, the fence section 30 may move along the assembly line 10 until the latter portion of the fence section 30 is in the area of the banding machine 16, as shown in FIG. 5. The fence sections 30 are banded using conventional banding techniques.

Figure 6:
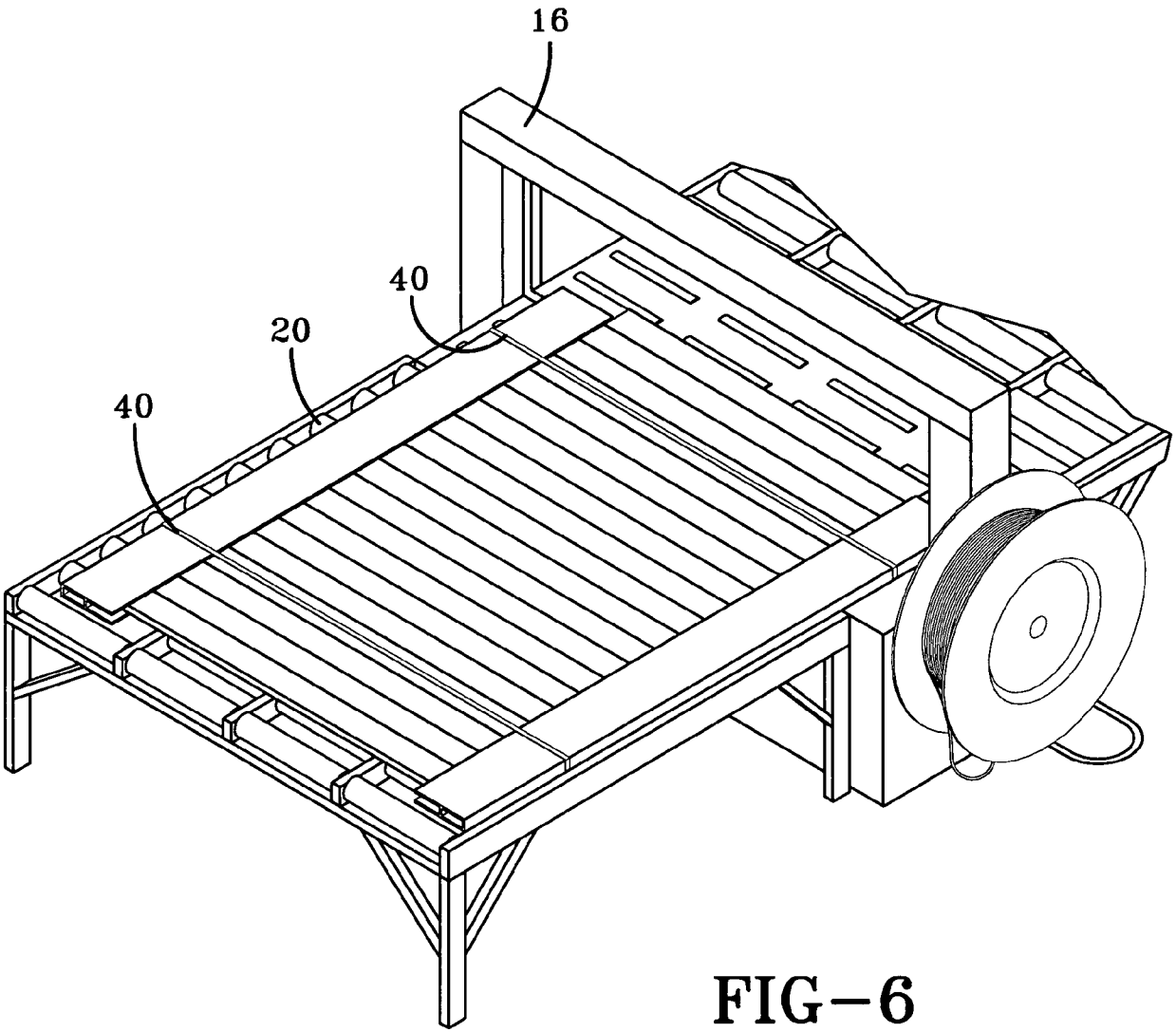
FIG. 6 is a top perspective view of a banded fence section.

Once banded, the fence section 30 moves along a second area of rollers 20 towards the end of the assembly line 10 and may then be placed into a shipping container such as a cardboard box. FIG. 6 shows a banded fence section 30 at the end of the assembly line 10 before it is placed into a box for transport to a different location.

The consumer is then able to purchase the desired number of fence sections and posts to suit their needs. At the site for the fence, the consumer may then insert a post into the ground in the desired locations. Once the fence posts are in place, the fence sections 30 may be placed in between the posts and secured thereto. After the fence sections 30 are in place, the bands 40 around each fence section 30 may be removed by the consumer with a knife or pair of scissors, for example.

A preferred material used to make the components of the fence section 30 is polyvinyl chloride (PVC) using conventional plastic extrusion equipment. However, the material type is not limited to PVC since the fence sections 30 may be made from other materials such as, but not limited to, other plastics, woods, and metals.

The bands 40 may be made of any material that is suitable to use with a banding machine, including but not limited to, any number of plastics or metals.

The method of assembling fence sections 30 using a banding machine 16 to secure the components of each fence section 30 together has a number of advantages. First, consumers can easily remove fence sections 30 from the box and transport them to the exact location where they are to be placed without the fence sections 30 falling apart and having to put them back together. Second, all of the problems associated with using glue, screws, rivets, or other fasteners are eliminated. This allows the fence to have the aesthetic appeal that consumers desire. Third, the fence pickets are able to move somewhat within the rail channels allowing for expansion and contraction of the material. Fourth, the ease in handling the fence sections 30 and productivity by assembly workers is greatly increased. The assembly workers do not have to deal with fence sections 30 coming apart as they are trying to move the fence sections 30 and while trying to place them into boxes and do not have to incur additional steps of assembly such as gluing, riveting, etc. This method of banding fence sections 30 has increased production rates of fence sections 30.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A method of assembling fence sections, the method comprising the steps of:

a. assembling fence pickets and rails to form a fence section;

b. positioning said fence section in the path of a banding machine; and c. banding said fence section with a band from said banding machine such that said band forms a tight, closed loop that extends from a first one of said rails to a second one of said rails and back to said first one of said rails, thereby wrapping entirely around said rails and holding said fence section together.

2. The method of claim 1, wherein said fence section comprises plastic rails and plastic pickets.

3. The method of claim 1 wherein said band is plastic.

4. The method of claim 1, wherein said rails have channels therein for receiving ends of said pickets.

5. The fence section assembled and banded as described in claim 1.

6. A method of assembling fence sections, the method comprising the steps of:

a. assembling a fence section, said fence section comprising a first rail, a second rail, and a picket connecting said first rail to said second rail; and b. wrapping a band around said fence section using a banding machine, said band forming a closed loop that extends from said first rail to said second rail and back to said first rail such that said first rail, said second rail, and said picket are secured together.

7. The method of claim 6 wherein:

said first rail has a channel that receives a first end of said picket when assembled; and said second rail has a channel that receives a second end of said picket when assembled.

8. The method of claim 6 further comprising the step of moving said fence section on rollers to a position to be wrapped with said band.

9. The method of claim 6 further comprising the step of transferring said fence section on rollers after said band has been wrapped around said fence section.

10. A method of assembling fence sections, the method comprising the steps of:

a. assembling a fence section, said fence section comprising a first rail, a second rail, and a picket connecting said first rail to said second rail;

b. wrapping a band around said fence section, said band forming a closed loop that extends from said first rail to said second rail and back to said first rail such that said first rail, said second rail, and said picket are secured together; and c. shipping said fence section to an installation site after said band has been wrapped around said fence section.

11. The method of claim 10 further comprising the steps of:

installing said fence section; and removing said band from said fence section.

12. A method of assembling fence sections, the method comprising the steps of:

a. assembling a fence section, said fence section comprising a first rail, a second rail, and a picket connecting said first rail to said second rail;

b. moving said fence section on rollers to a banding machine;

c. wrapping a band around said fence section, said band forming a closed loop that extends from said first rail to said second rail and back to said first rail such that said first rail, said second rail, and said picket are secured together;

d. transferring said fence section on rollers after said band has been wrapped around said fence section;

e. shipping said fence section to an installation site;

f. installing said fence section; and g. removing said band from said fence section.

* * * * *